US005655775A

United States Patent [19]

Pontus et al.

[11] Patent Number: 5,655,775

[45] Date of Patent: Aug. 12, 1997

[54] RIFLE RANGE BACKSTOP

[75] Inventors: John Pontus, Rock Hill, S.C.; Stephen H. Young, Huntsville, Ala.

[73] Assignee: Lockheed Martin Tactical Systems, Inc., Bethesda, Md.

[21] Appl. No.: 716,853

[22] Filed: Sep. 16, 1996

Related U.S. Application Data

[63] Continuation of Ser. No. 339,778, Nov. 15, 1994, abandoned.

[51] Int. Cl.[6] ..... F41J 1/12

[52] U.S. Cl. ..... 273/410; 89/36.02

[58] Field of Search ..... 273/410

[56] References Cited

U.S. PATENT DOCUMENTS

| | | | |
|---|---|---|---|
| 2,013,133 | 9/1935 | Caswell | 273/410 |
| 3,701,532 | 10/1972 | Nikoden | 273/410 |
| 3,982,761 | 9/1976 | DeVogelaere | 273/410 |
| 4,509,301 | 4/1985 | Head | 52/79.8 |
| 5,070,763 | 12/1991 | Coburn | 89/36.02 |
| 5,121,671 | 6/1992 | Coburn | 89/36.02 |

OTHER PUBLICATIONS

*Indoor Range Design Criteria* published by the National Rifle Association (1988).

*Primary Examiner*—William H. Grieb

*Attorney, Agent, or Firm*—Albert T. Keyack; Steven J. Rocci; Stanton D. Weinstein

[57] ABSTRACT

A backstop and bullet trap are disclosed that provide access from the front so that spent projectiles can be removed without requiring a crawl space along the side or rear of the backstop, thereby permitting maximum use of the interior space into which the backstop and bullet trap have been installed. The present invention discloses a backstop that has a removable panel on the lower edge of a lower deflector. Preferably the lower panel overlies the lower deflector and is hingably connected to the floor or near the floor. In a preferred embodiment, this hinge connection is provided by resting the lower edge of the removable panel in a recess in the floor. In this embodiment, the removable panel presents an angled deflector surface to the shooter and no additional floor deflectors are required. Methods of removing projectiles from a backstop and bullet trap are also disclosed.

10 Claims, 1 Drawing Sheet

RIFLE RANGE BACKSTOP

This is a continuation of application Ser. No. 08/339,778, filed Nov. 15, 1994 now abandoned.

The present invention relates to improvements in shooting ranges, and more particularly to backstops and bullet traps for rifle ranges.

BACKGROUND OF THE INVENTION

One type of conventional rifle range backstop known as an escalator backstop has a general configuration in the shape of sideways "V." The design of the trap causes the bullets to be directed to the apex of the "V" and fall into a trap at the rear of the backstop. The "*Indoor Range Design Criteria*" published by the National Rifle Association sets forth the general requirements for an escalator type backstop at ¶ 3.01.06(2). Typical escalator trap designs use a series of overlapped plates to form a deflecting surface, with the direction of overlap being chosen so that a flat edge is never exposed in the direction facing the shooter.

Another conventional type of backstop is the angled plate and trap, which is similar to the escalator trap in its general shape, but uses flat plates and deflects the projectiles into a sand or water trap. For example, U.S. Pat. No. 3,982,761 —DeVogelaere, discloses a backstop designed for air guns and pellet guns. The backstop plate is designed so that the energy of the pellet is absorbed and the pellet drops into a trap area at the rear of the structure.

One aspect of the design of backstops and bullet traps generally is the removal of the spent projectiles, which are typically lead or lead alloy bullets or pellets. Lead is a hazardous substance, and for this reason alone should not be permitted to accumulate inside the structure of a shooting range. Additionally, it is necessary to clean out accumulated spent projectiles for reasons of shooting safety and to ensure proper operation of the backstop, bullet trap, and associated equipment such as target hangers and the like.

Thus, in the prior art, a hinged door or some other type of removable section or clean out port was provided at the rear of a backstop. Typically, a crawl space or other rear area access was provided between the backstop and the wall to permit the removable section to be opened, thus permitting the spent bullets in the trap to be collected.

For example, U.S. Pat. No. 4,509,301 to Head discloses a modular shooting range that includes a bullet trap that uses an angle plate-type design. The bullet trap is provided with a clean out door that is beneath the rear section of the backstop, just ahead of a water-filled bullet trap. U.S. Pat. Nos. 5,070,763 and 5,121,671, both to Coburn, disclose an angle plate bullet trap that is connected to a spiral chamber where bullets dissipate energy before falling into a water-filled collecting vessel. The trap is designed so that the fired bullets can be retrieved and examined. A clean out door is provided along the side of the spiral chamber, near the rear of the device.

If a number of either of the prior art designs are installed in an indoor setting adjacent to one another, provision would have to be made either for a rear access or side access area. However, because space is at a premium in indoor shooting ranges, it is desirable to place the rear of the backstop against a wall, permitting the longest possible range distance, and to place adjacent targets and backstops as close to one another as feasible to maximize the number of shooters who can use the range at one time. These considerations are of course contrary to the requirements described above that relate to providing access for cleaning out the spent projectiles.

It would therefore be desirable to provide a backstop and bullet trap design that maximizes available interior space by permitting the backstop to be placed adjacent a rear wall, while also permitting backstops to be placed adjacent one another. It is also desirable to provide access to a bullet trap so that the spent projectiles can be collected on a regular basis. It is therefore an object of the present invention to provide a backstop design wherein access to spent projectiles from the rear or side of the backstop is not required.

SUMMARY OF THE INVENTION

The present invention provides an improvement for shooting ranges for rifles or other arms wherein an access door is provided on the bottom slope of the "V" to permit access to the interior of the trap and thus to the location where the spent bullets are collected. Since access is from the front of the backstop, it can now abut a wall.

In a preferred embodiment of the present invention, the trap comprises an upper deflector and a lower deflector that are both angled toward an apex, and an opening near the apex connects to the bullet trap. In accordance with the present invention, a section of the lower deflector comprises a removable panel, and when the panel is removed, access to the bullet trap at the rear of the backstop can be made from the front. The access opening exposed by removing the removable panel permits vacuum cleaners or other tools to be inserted into the interior of the backstop in order to retrieve the spent projectiles. Most preferably, the removable panel is disposed within a recess in the floor and overlies the lower section of the lower deflector. In this embodiment, the lower deflector presents an angled deflector to the shooter and no further provision must be made to provide a deflector at the floor.

DETAILED DESCRIPTION OF THE PREFERRED EMBODIMENTS

Figure 1:
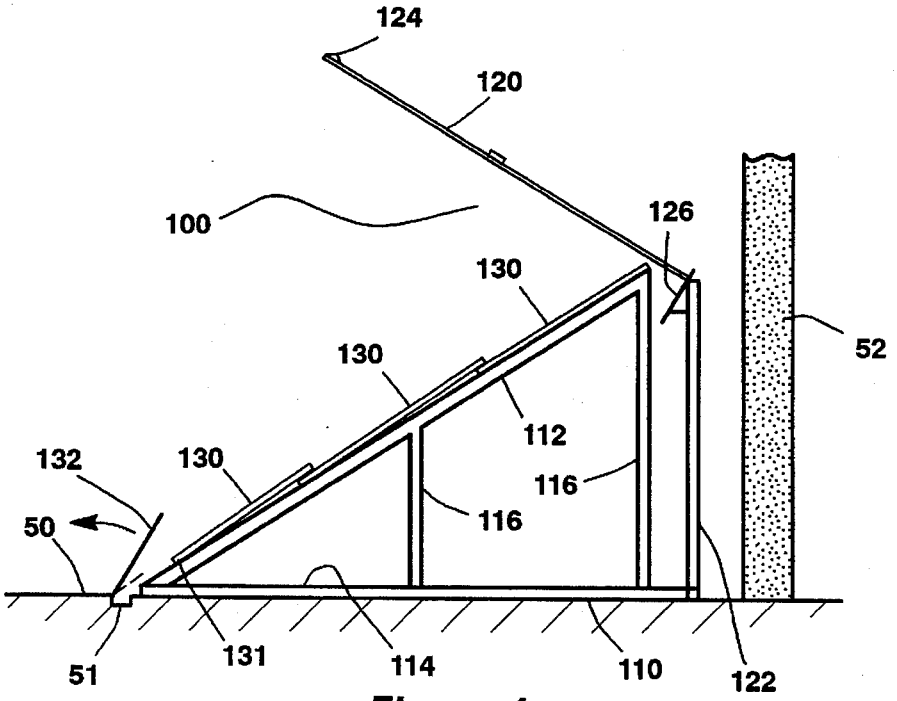
FIG. 1 is a side elevation view of a backstop made in accordance with the present invention.

A side view of a backstop 100 made in accordance with the present invention is illustrated in FIG. 1. The backstop 100 is shown as being mounted to a floor 50 and adjacent to a rear wall 52. Those of skill in the art will understand the design requirements for the floor 50 and wall 52. Additionally, it should be noted that the structure shown is, unless otherwise noted, fabricated from steel structural shapes and steel plates. The thickness, hardness and type of steel depends upon factors such as the length of the range, the type of ammunition the backstop must contain, and other factors known in the art. The construction of the backstop uses conventional techniques, also familiar to those of ordinary skill.

Although the present invention is described herein with reference to rifle ranges, it will be appreciated that the concepts of the present invention are applicable to any type of firearm or projectile, including air and $CO_2$ powered guns, spring guns and the like.

Referring still to FIG. 1, it can be seen that the sideways "V" shape typical of both escalator and angled plate backstops is created by a lower structure 110 and upper deflector plate 120. The upper deflector plate 120 is of conventional design and is preferably supported by a support 122 and attached to a ceiling or other upper surface (not shown) by an upper bracket 124. The juncture between the upper deflector plate 120 and the lower support 122 also includes a bullet deflector 126 that ensures that the projectiles fired into the trap are directed into the area between the lower structure 110 and the lower support 122.

Figure 2:
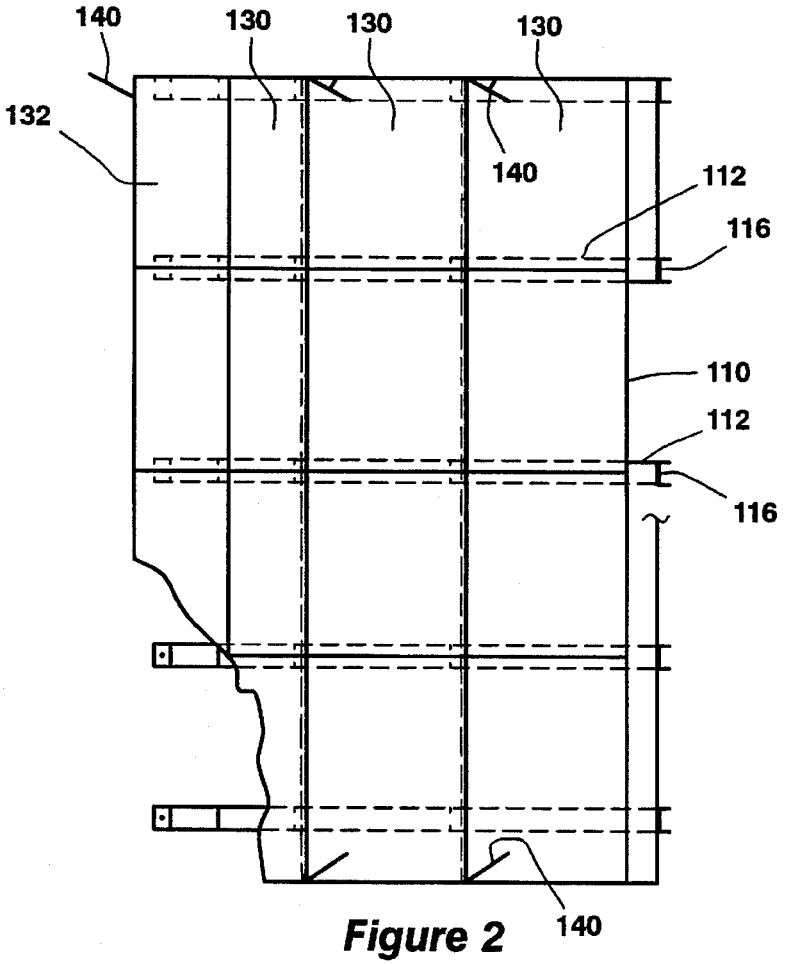
FIG. 2 is a plan view of the backstop illustrated in FIG. 1.

The details of the lower structure 110 are best understood with reference to both FIGS. 1 and 2. The lower structure 110 is preferably comprised of deflector support rails 112, floor rails 114 and vertical supports 116. These components are most preferably formed from 3½×3½×¼ angle iron, although other structural shapes can be used, so long as they provide adequate support for the structure. In the preferred embodiment illustrated, the top surface of the deflector support rails is covered with a set of deflector plates 130 that are overlapped as shown. The overlapping of the deflectors 130 is chosen so that a flat plate edge is never presented to the shooter, since such a flat surface would create a ricochet hazard.

Immediately in front of the lower structure 110 and overlapping one of the deflector plates 130 is a removable deflector 132. In the preferred embodiment shown, the removable deflector is mounted in a recess 51 in the floor 50, and as shown, pivots within the recess 51. In use, the removable deflector is pivoted toward the deflector plate 130 and overlaps it, so that the entire front edge of the lower structure 110 presents a sloped deflecting surface to the shooter. However, when it is necessary to access the rear of the backstop to clean out spent projectiles or for other reasons, the removable plate 132 can be pivoted away from the deflector plate 130 and removed from the recess 51. The dimension between the floor 50 and the bottom edge 131 of the lowermost deflector 130 is sufficient so that tools such as vacuum cleaners, hoses or brooms can be inserted beneath the backstop 100, all the way to the back wall 52. Intermediate structure is kept to a minimum, and it should be understood that except for the uprights created by the vertical supports 116, there are no obstructions that prevent cleaning out the rear of the trap.

Additional details of the backstop 100 are shown in FIG. 2, where it can be seen that the backstop 100 is preferably provided with side deflectors 140 which are vertical panels that deflect stray projectiles toward the center of the trap.

Although the lower deflector plates 130 were described above, it will be appreciated that the deflector 130 can be comprised of a continuous plate that overlaps the removable plate 132. Additionally, although mounting the removable plate 132 in a floor recess 51 represents a preferred embodiment of the present invention, other mounting structures can also be used. For example, the recess 51 can be replaced with a piece of C-channel or the like, if provision is made to cover the vertical surface presented to the shooter with a small angled plate. The removable plate can also be affixed to the lower structure 110 in a manner whereby its lower edge is flush with the floor 50 when in place. These later embodiments are somewhat more complicated and expensive, however, and the illustrated embodiment is therefore preferred.

The present invention also discloses methods of removing projectiles from a backstop and bullet trap by removing a removable panel from a front section of a lower deflector of the backstop, preferably by pivoting the panel about its a lower edge, which is most preferably disposed within a recess in the floor surface. By removing this panel an access opening is exposed, and a tool such as a vacuum tool is inserted into the access opening. Projectiles collected within the bullet trap are then removed and the removable panel is replaced.

Although certain embodiments of the present invention have been described above with particularity, these embodiments are meant to illustrate the invention and are not meant to limit its scope. For example, numerous deflector designs can take advantage of the front access panel concept disclosed above. Upon review of the foregoing specification, those of skill in the art will realize many adaptations, modifications and variation of the components described above that utilize the present invention while departing from the specific design illustrated. Thus, reference should be made to the appended claims in order to ascertain the full scope of the present invention.

What is claimed is:

1. A backstop and bullet trap comprising an upper deflector and a lower deflector angled toward an apex, wherein the lower deflector is comprised of a deflector plate and a removable plate disposed in a recess in a floor surface; and a bullet trap connected to the apex, whereby the bullet trap is accessed by removing the removable plate.

2. The backstop and bullet trap of claim 1, wherein the removable plate is pivotable from a closed position to an open position.

3. The backstop and bullet trap of claim 1, wherein the removable plate overlaps the deflector plate.

4. The backstop and bullet trap of claim 1, wherein the deflector plate is comprised of one or more overlapping plates.

5. The backstop and bullet trap of claim 1, wherein the upper deflector comprises an upper deflector plate attached to a lower support.

6. The backstop and bullet trap of claim 5, further comprising a bullet deflector disposed at a juncture between the upper deflector plate and the lower support, whereby projectiles are directed into an area between the backstop and trap and the lower support.

7. A backstop and bullet trap comprising an upper deflector and a lower deflector, wherein the lower deflector comprises a removable panel having an upper edge overlying the lower deflector and a lower edge hingably mounted to a structure adjacent a floor surface, wherein no flat surface of said structure faces an oncoming bullet.

8. The backstop and bullet trap of claim 7, wherein the lower edge is disposed in a recess in the floor.

9. A method of removing projectiles from a backstop and bullet trap comprising the steps of:

removing a removable panel from a front section of a lower deflector of the backstop to expose an access opening by pivoting a lower edge of the lower deflector within a recess in a floor surface;

inserting a tool into the access opening;

removing projectiles collected within the bullet trap; and replacing the removable panel.

10. The method of claim 9, wherein the step of removing projectiles collected within the bullet trap comprises inserting a vacuum tool through the access opening.

* * * * *